United States Patent [19]

Ikechi

[11] 4,085,415

[45] Apr. 18, 1978

[54] PHOTOGRAPHIC PROCESSING APPARATUS

[75] Inventor: Masai Ikechi, Tokyo, Japan

[73] Assignee: Fuji Photo Film Co., Ltd., Japan

[21] Appl. No.: 683,645

[22] Filed: May 6, 1976

[51] Int. Cl.[2] ..... G03D 17/00; G03D 13/02

[52] U.S. Cl. ..... 354/316; 354/312; 354/337; 354/331

[58] Field of Search ..... 354/297, 307, 310, 312, 354/315, 316, 331, 333, 337, 347

[56] References Cited

U.S. PATENT DOCUMENTS

| | | | |
|---|---|---|---|
| 615,143 | 11/1898 | Cozzens | 354/315 |
| 758,277 | 4/1904 | Peters | 354/315 |
| 855,402 | 5/1907 | Hayden | 354/315 |
| 2,193,457 | 3/1940 | Hogan | 354/315 X |
| 2,732,779 | 1/1956 | Beard et al. | 354/307 |

*Primary Examiner*—Fred L. Braun

[57] ABSTRACT

A photographic processing apparatus includes a developing tank, a fixing tank, a moving plate structure in the form of an open framework guided between the developing tank and the fixing tank, for carrying thereon a sheet of printing paper from the former to the latter. These tanks and the moving plate structure are enclosed in a box-type casing provided at top with a light-filtering cover. Thus, the developing and fixing operations can be carried out in a brightly lighted room.

7 Claims, 8 Drawing Figures

PHOTOGRAPHIC PROCESSING APPARATUS

BACKGROUND OF THE INVENTION

1. Field of the Invention

This invention relates to a photographic processing apparatus, and more particularly to an apparatus of the type which permits all print processing operations to be performed in a light-screened processing bath in a brightly lighted room.

2. Description of the Prior Art

It is a conventional manner to develop and fix sheets of printing paper in a darkroom. Usually, after an exposure process such as enlargement, the printing sheet is first immersed in a developing tank under illumination of a safelight, and is then caught with a pick-up pincette to be moved from the developing tank to a fixing tank. These processing operations involve numerous difficulties and cannot be performed without a darkroom. If, in the course of the operations, it should become necessary to locate or sort negative films, this work is made difficult by the fact that the light cannot be turned on in the darkroom until the fixing process is completed. If illumination becomes absolutely necessary during the developing operation, a light-screening cover may be used to shield the developing tank from light. It goes without saying, that the developing operation cannot be continued at this time. Thus the light must always be turned off during the developing operation, and the printing paper must be moved to the fixing tank in the dark.

SUMMARY OF THE INVENTION

In view of the above problems, the principal object of the present invention is to provide a photographic processing apparatus which permits all processing operations, including the movement of the printing paper sheets from the developing tank to the fixing tank, to be performed easily in a light-shielded processing bath or casing even when the processing operations are carried out in a brightly lighted room.

In order to achieve the above object, the apparatus according to the invention consists essentially of a safelight-filtering casing, developing and fixing tanks or containers, guiding means extending between the tanks, and a moving plate structure adapted for carrying sheets of printing paper being guided by the guiding means from the developing tank and to the fixing tank, whereby the moving plate structure can pick up a printing sheet in the developing tank, carrying the sheet to the fixing tank, and drop it into the fixing tank. As is easily understood from the above, the features of the invention include the moving of printing paper sheets between the developing and fixing tanks within a covered casing so that the developing and fixing operation can be performed in a brightly lighted room. If an enlarging apparatus also provided with a safelight-filtering cover is connected to the apparatus of the invention through the inlet thereof for introducing printing sheets thereinto, all processing operations including enlarging, developing and fixing can be carried out in a brightly lighted room, namely, without need for a darkroom.

DESCRIPTION OF THE PREFERRED EMBODIMENTS

The invention will now be described in more detail with reference to several preferred embodiments thereof.

Figure 1:
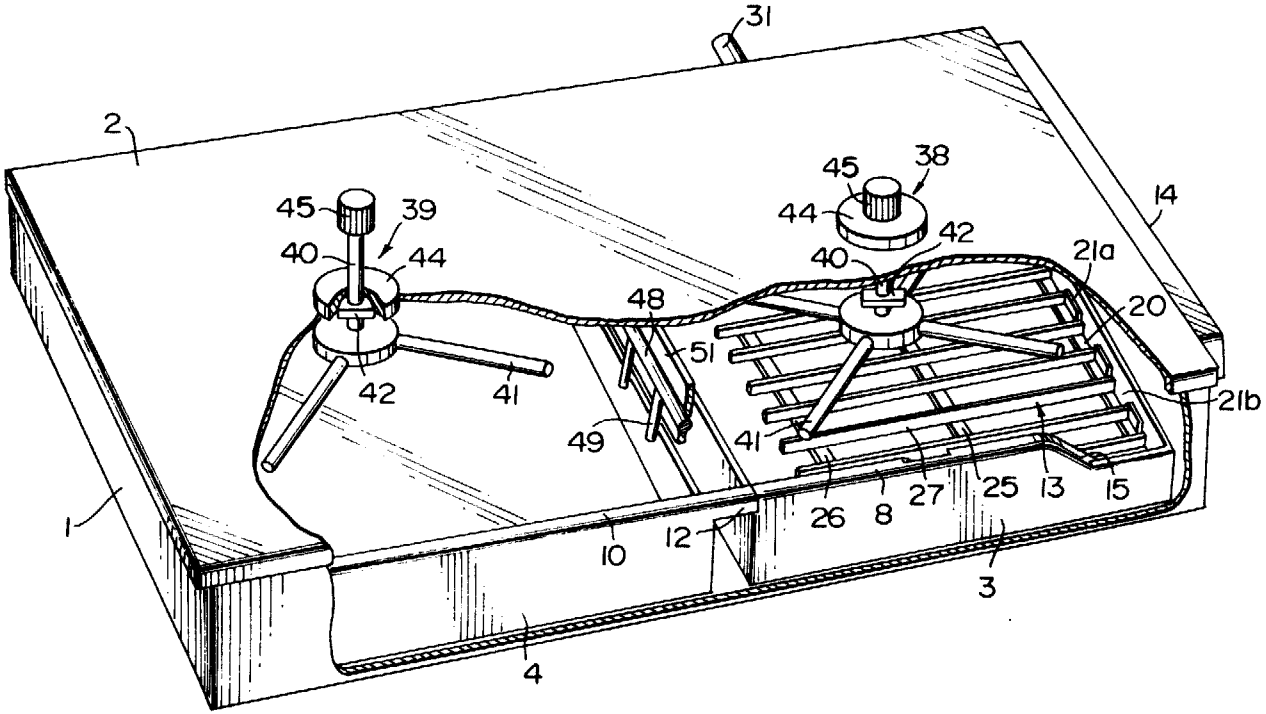
FIG. 1 is a perspective view partially broken away illustrating a processing apparatus in accordance with a preferred embodiment of the invention.
Figure 5:
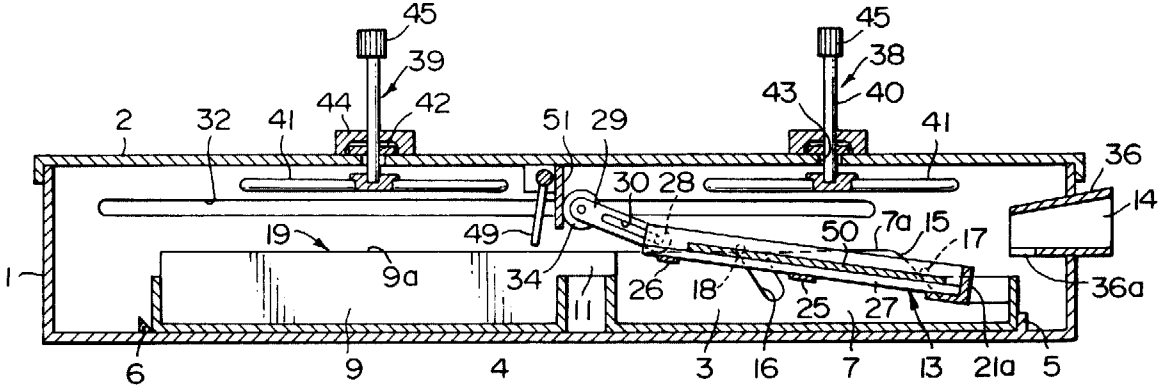
FIG. 5 is a vertical sectional view of the apparatus illustrating how the moving plate is moved up from inside the developing tank.

Referring first to FIG. 1 which is a perspective view partially broken away illustrating the photographic processing apparatus embodying the invention, reference numeral 1 designates a box-type casing or processing bath provided at the top thereof with a removable cover 2. If the casing 1 and the cover 2 are made of sharp-cut light filtering material which has a critical transmission wavelength of 580nm to 620nm, and printing paper sheets which have a sensitivity of about JIS 20 to 100 are used, the developing and fixing operations can be carried out while viewing the inside of the apparatus through the casing 1 and the cover 2 in a brightly lighted room. The casing 1 accommodates therein a developing tank or container 3 and a fixing tank or container 4 containing developer and fixer solutions therein, respectively. As shown in FIG. 5, projections 5 and 6 are provided on the bottom of the casing 1 for securing the tanks 3 and 4 in position inside the casing 1. The developing and fixing tanks 3 and 4 have a box-type form open at the top, and have two parallel side walls 7, 8 and 9, 10 of like height. The remaining two parallel end walls of each tank are lower than the side walls 7, 8 and 9, 10. The side walls 7, 8 of the developing tank 3 are in linear alignment with the corresponding side walls 9, 10 of the fixing tank 4 and together with bridging members 11 and 12 extending from one end of side walls 9, 10 of the fixing tank 4, form two parallel continuous guideways on which a moving plate structure 13 travels. (Plate structure 13 will be described later.) The parallel side walls 7 and 8 of the developing tank 3 are similar in construction to each other and for convenience of explanation only the construction of one side wall 7 of the tank 3 will be described with reference to FIG. 2. The side wall 7 of the tank 3 has a first slope 15 extending obliquely downward towards the inlet 14 and into the tank 3, and a second slope 16 of greater inclination. As shown particularly in FIGS. 3 and 5, the moving plate structure 13 is provided on its opposite sides with pairs of pins 17 and 18. The pair of pins 17, 18 on each side is engaged with the slopes 15 and 16, respectively so as to be guided thereby. When the pins 17 and 18 are at the lowest positions of the slopes 15 and 16, they support the moving plate structure 13 at a level where it is immersed in the tank 3. As the two slopes 15 and 16 have different inclinations, movement of the structure 13 from the tank 3 toward the tank 4 causes the structure 13 to be tilted so as to drain the developing chemical solution therefrom.

The moving structure 13 is guided on either side by a guiding structure 19 comprising the upper edge 7*a* of the side wall 7 of the tank 3, the slopes 15 and 16 cut deep through the side wall 7, and the upper edge 9*a* of the side wall 9 of the tank 4. Thus, the moving structure 13 can travel along the guiding structure 19 between the two tanks 3 and 4 in such a manner that it is immersed in the tank 3 and travels above the tank 4. The guiding structure 19 may have a modified form in which a projection strip is provided on the inside of the casing 1 or of the cover 2 to protrude inwardly of the casing 1. In such case, the structure 13 rides on the upper surface of the projection strip. In still another modified form, a pair of guiding channels grooves or apertures is provided for guiding the structure 13. If guiding apertures are used, the apertures should be provided above the level of the tank 3 with the pins 17 and 18 located higher on the side wall of the structure 13, thus preventing the escape of developing solution through the apertures.

Figure 2:
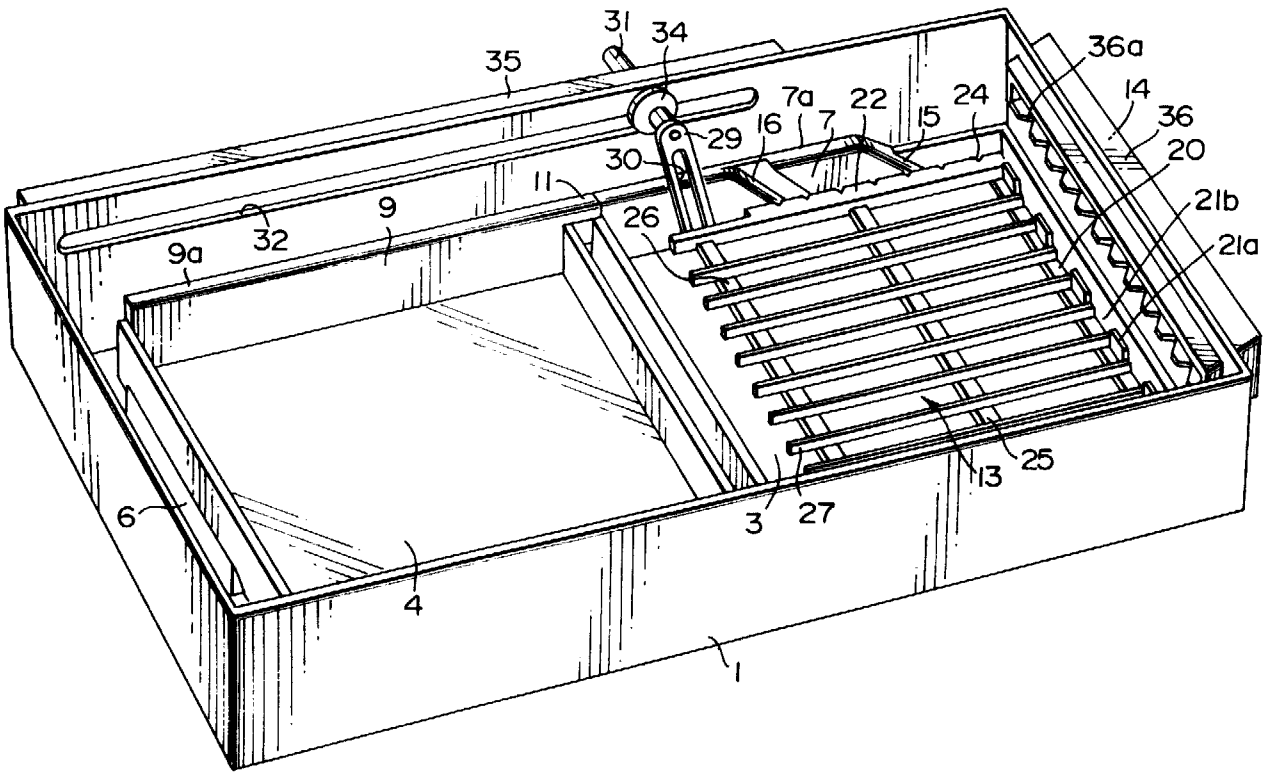
FIG. 2 is a perspective view illustrating the same with the cover removed.

The moving plate structure 13 has an open framework arrangement constructed as will now be described with reference to FIGS. 2 and 3. As shown, a member 20 extends transversely with respect to the side walls 7, 8 of the tank 3 and has a plurality of raised portions 21*a* and recesses 21*b* arranged alternately at regular intervals. Two parallel members 22 and 23 extend longitudinally of the casing 1, forming the outer framework of the structure 13 together with the member 20. The members 22 and 23 have a plurality of V-shaped notches 24 at regular intervals on the outer sides thereof. The V-shaped notches 24 serve to prevent a suction force from arising between the members 22 and 23 and the opposite side walls 7 and 8 of the tank 3 because of the developing chemical solution adhering to the members 22 and 23. Two parallel members 25 and 26 having their respective extremities secured to the undersides of the members 22 and 23 extend across the space between the members 22 and 23. A plurality of parallel members 27 extend in regularly spaced relation in parallel to the members 22 and 23 and across the members 25 and 26. One end of each member 27 is supported by the member 20. As shown particularly in FIGS. 1 and 2, members 27 are supported by the member 20 in pairs in such manner that one of each pair is seated on either side of a cutout 21*b*. The members 27 have the upper ends thereof above the bottom of the cutout 21*b*. As seen from the above, the moving plate structure 13 has a latticed framework arrangement consisting of the members 25, 26 and 27 from the bottom of which a developing solution can be drained when the structure 13 moves up from inside the tank 3 in which it has been immersed. The regular spaces formed by the members 25, 26 and 27 are large enough to prevent the developing solution from forming a film over the spaces. The tops of the members 25, 26 and 27 should preferably be semi-circular or pointed so as to prevent close adhesion of the printing sheets to the upper faces.

Figure 3:
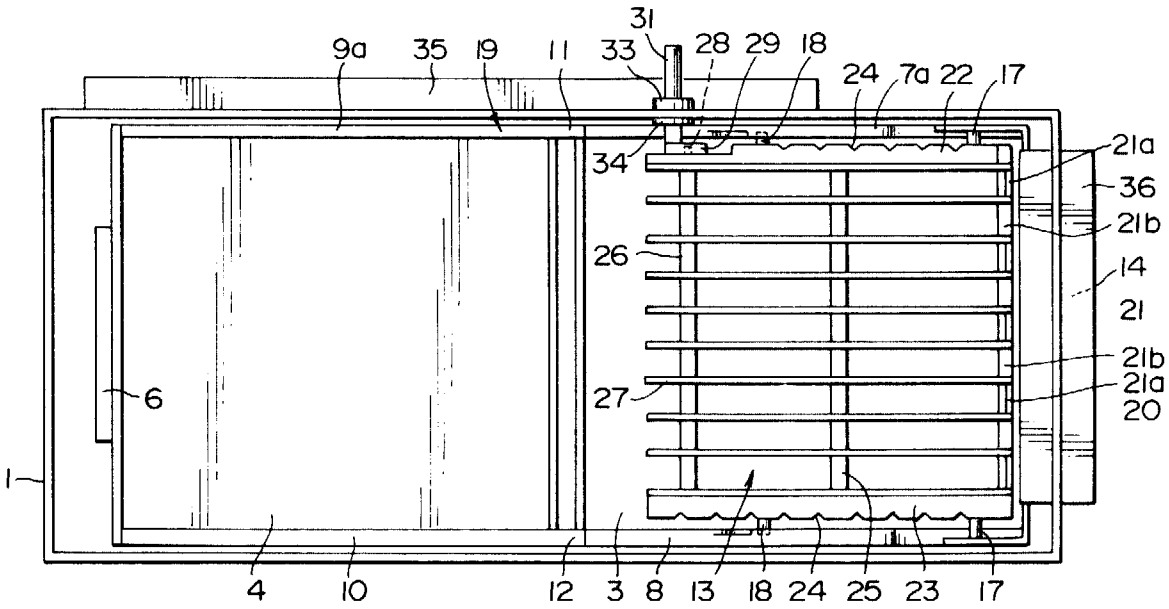
FIG. 3 is a plan view of the apparatus as shown in FIG. 2.
Figure 4:
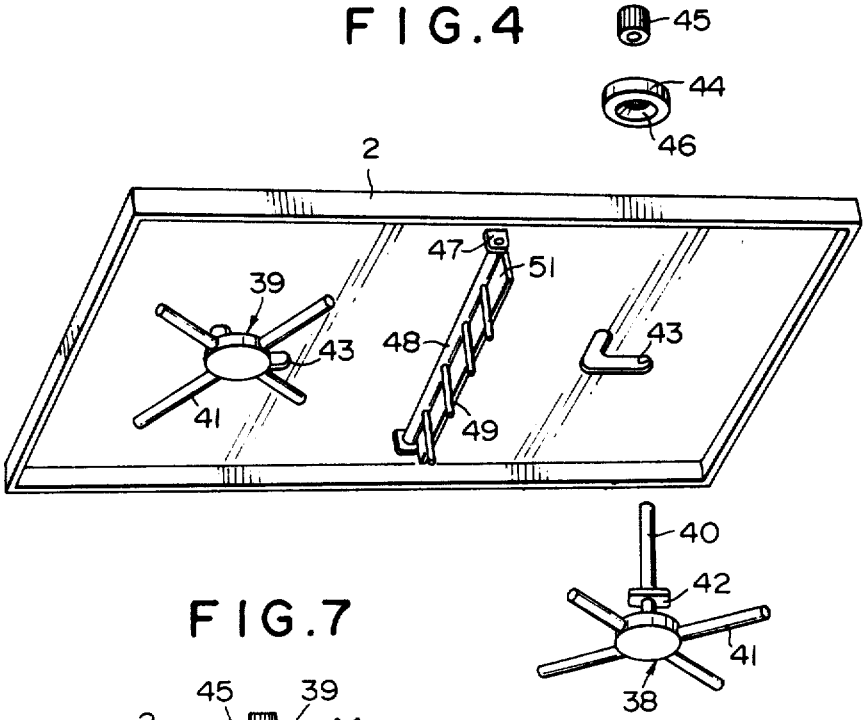
FIG. 4 is an exploded perspective view illustrating the inside of the cover of the apparatus.

As shown in FIG. 3, each of the members 22 and 23 has a pair of the earlier-mentioned pins 17 and 18. In order to prevent the pin 17 from moving down the slope 16 when traveling thereover, the face of slope 15 is of greater breadth than that of the slope 16 and the pin 17 is longer than the pin 18. The member 22 has a further pin 28 secured thereto as shown in FIGS. 3 and 5, and the pin 28 movably fits in a rectangular slot 30 of a pulling lever 29, as shown in FIGS. 2 and 5. To one end of the lever 29 is secured an operating handle 31 having the form of a rod which projects out of the casing 1 through a rectangular slot 32 extending longitudinally of the casing 1. The handle 31 has rounded washers 33 and 34 on the inner and outer sides of the casing 1, the washers 33 and 34 holding the handle 31 from movement in axial direction. The casing 1 is provided on one side with a covering means 35 of safelight-filtering material or the like which covers the slot 32, as shown in FIGS. 2 and 5, thus preventing light from coming through the slot 32 into the casing 1 from above. A similar covering means 36 of rectangular form is provided for covering the inlet 14 of the casing 1. The covering means 36 extends through the end wall of casing 1 with its roof sloping downwardly toward the inside so as to define a narrower mouth on the inside through which printing sheets are passed into the tank 3. The floor of the covering means 36 has a plurality of triangular notches 36*a* spaced at regular intervals longitudinally thereof. The notches 36*a* provide easy finger insertion means by which a printing sheet can be moved by the finger forward into the casing 1 or tank 3 so that the trailing edge of the sheet can easily be moved away from the lower portion of the covering means 36. The notches 36*a* are shown to be of triangular shape but the shape of the notches is not limited to that shown. The notches 36*a* may be of other shapes such as semi-circular so long as easy finger access is afforded. As shown in FIGS. 1 and 4, the cover 2 of the apparatus has two agitators 38 and 39 which are movable up and down with respect to the developing and fixing tanks 3 and 4, respectively. The agitators 38 and 39 have both agitating and anti-curling functions. More particularly, during the developing and fixing operations, the printing sheet can be immersed completely in the solutions and prevented from being curled by operating the agitators 38 and 39. The agitator 38 which is identical in structure with the agitator 39 includes a spindle 40, a plurality of rods 41 at the lower end of the spindle 40 which extend in the radial direction, and a stopper 42 slightly above the rods 41. The cover 2 has two substantially L-shaped openings through which the spindles 40 of the agitators pass. Each L-shaped opening 43 has a portion of greater length which is long enough to pass the stopper 42 of the agitator 38 when the length of the stopper 42 registers with that portion of opening 43. Thus the stoppers 42 can be lifted through the opening 43 and outside the cover 2. With the stopper 42 outside the cover 2, the spindle 40 is turned on its axis so that the length of stopper 42 is brought out of registry with the longer portion of the opening 43. Thus, the spindle 40 is prevented from lowering. If the spindle 40 is moved toward the shorter portion of the opening 43, it can be retained in the raised position without the need of turning it. A light filter 44 movably fits around the spindle 40 from the above and serves to shield the opening 43 from light. The spindle 40 has a knob at the lower end thereof. The filter 44 has a recess 46 at the lower side thereof in which the stopper 42 is accommodated for rotation. The inside of the cover 2 has stopper means comprising a pair of bearings 47 which rotatably support a shaft 48. The shaft 48 carries a plurality of tines 49 extending downwardly thereof for catching a printing sheet by the trailing edge. The tines 49 are spaced at regular intervals and are aligned with the corresponding cutouts 21*b* of the member 20. The tines 49 are of such length that the lower ends thereof reach the member 25. Thus, forward movement of the structure 13 past the tines 49 prevents the structure 13 from striking against the tines 49, and movement of the structure 13 past the tines 49 and back to the tank 3 causes the trailing edge of the printing sheet 50 to be caught by the tines 49 so that the sheet 50 can be held from going back when the structure 13 returns toward the tank 3. In this manner, the sheet 50 is thrown into the tank 4 after the structure 13 has returned to the tank 3.

Figure 6:
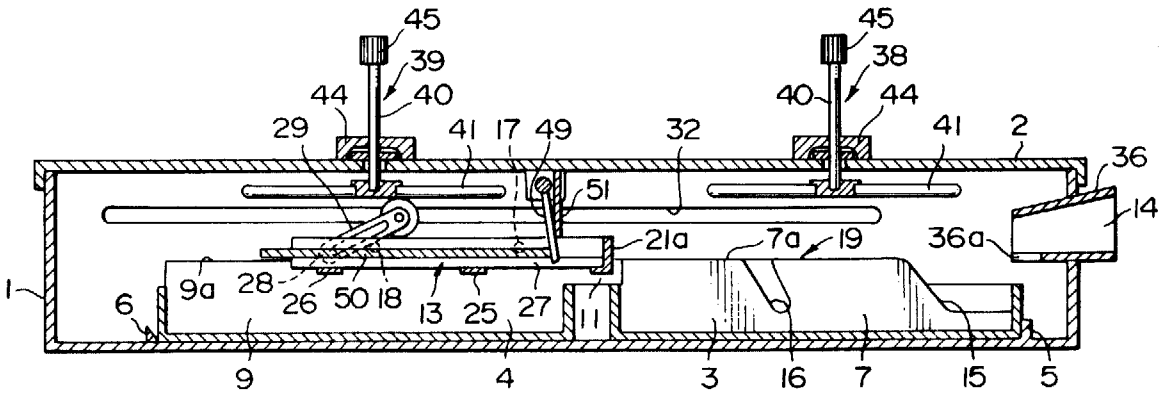
FIG. 6 is a vertical sectional view of the apparatus illustrating how the moving plate moves back to the developing tank.

The inside of the cover 2 also has a plate 51 which prevents the rotation of the tines 49 in anticlockwise direction in FIG. 6. If the shaft receiving apertures of bearings 47 are made long in the vertical direction so that the shaft 48 can both rotate and move up and down, the tines 49 can easily ride over the printing sheet 50 and save it from being scratched or otherwise damaged. The lower ends of the tines 49 should preferably have rounded heads to protect the printing sheet 50 from scratches. The plate 51 preventing the anticlockwise rotation of the tines 49 may be replaced with a hook means extending from the bearings 47 or from the inside of the cover 2 to engage with one of the tines 49 for stopping it from further rotation.

In the above embodiment, the casing 1 accommodates two tanks 3 and 4 therein. However, it may instead comprise two rooms separated by a partitioning member, the two rooms containing developing and fixing solutions, respectively.

For clarity and easy understanding of the apparatus described above, its operation will now be explained. Let it first be assumed that the moving plate structure 13 is immersed in the developing tank 3 as indicated in FIGS. 1 through 3 and a sheet of exposed printing sheet 50 is passed from the enlarging apparatus (not shown) through the inlet 14 and into the tank 3. The stopper 42 of agitator 38 is turned to bring its length into registry with that of the L-shaped opening 43 and the spindle 40 is then lowered through the opening 43. The printing sheet 50 is held by the radial rods 41 of the spindle 40 in the manner shown in FIG. 7 in respect of agitator 39 in tank 4 and is then wholly immersed in the developing tank 3 under the lowering action of the rods 41. With the sheet 50 immersed, the developing solution in the tank 3 is stirred by turning the spindle 40 on its axis at regular time intervals. The stirring operation is continued over a predetermined period or until it is determined by observation through the casing that the developing process has advanced sufficiently. The spindle 40 is then pulled upwardly by the knob 45 so that the rods 41 move away from the tank 3. Handle 31 is then drawn along the slot 32 toward the tank 4 to cause the moving structure 13 carrying the sheet 50 thereon to clear the tank 3. The raised portions 21*a* on the moving plate structure 13 push the sheet 50 thereon forward as the structure 13 is moved towards the tank 4. It has been described that the slope 16 has a greater inclination than the slope 15. This difference in inclination results in the moving structure 13 being titled as indicated in FIG. 5 so as to drain the developing solution off the structure 13 and the printing sheet lying thereon. Further movement of the handle 31 causes the pins 17 and 18 of the structure 13 to be guided onto the upper edges 7*a* and 8*a* of the side walls 7 and 8, placing the structure 13 in a horizontal position. The moving structure 13, carrying the sheet 50 thereon, travels along the guiding structure 19, forcing the tines 49 forward to allow the structure 13 to pass thereunder. When the handle 31 reaches the end of the slot 32, it is moved backward causing the lever 29 to turn on its axis in a reverse or clockwise direction while the pin 28 of the structure 13 travels along rectangular slot 30 and the structure 13 remains stationary. Further backward movement of the handle 31 causes the structure 13 to travel backward moving past the tines 49 without coming in contact therewith as indicated in FIG. 6. This is possible because of the presence of the cutout portions 20 of the structure 13. However, the sheet 50 which is held on the members 27 is prevented by the tines 49 from moving backward. Thus, the structure 13 moves back to the position as shown in FIGS. 1 to 3 while the sheet 50 is held by the tines 49 to eventually drop into the tank 4.

Figure 7:
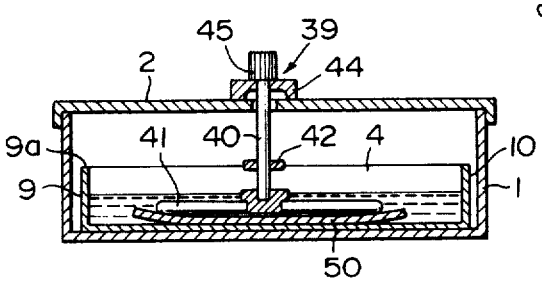
FIG. 7 is a vertical sectional view of the fixing tank, showing how an agitating device is lowered for holding the printing paper.
Figure 8:
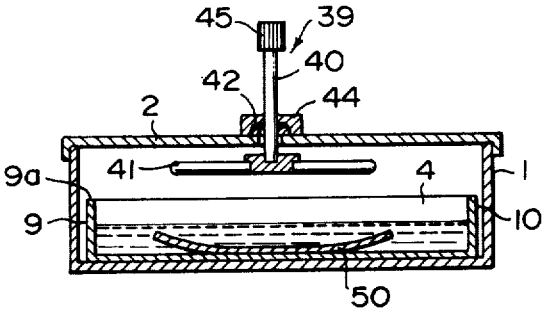
FIG. 8 is a vertical sectional view of the fixing tank showing how the agitating device is raised away from the printing paper.

As previously described in the developing operation, the agitator 39 is lowered as indicated in FIG. 7 and the fixing operation is carried out by stirring the fixing solution and correcting curls in the sheet 50, if any. When the fixing operation is completed, the agitator 39 is again moved up. Then, the cover 2 is removed from the casing 1 and the processed sheet 50 is picked out from the casing 1 by using a pincette or the like. The washing and drying operations follow in the usual manner.

As it is apparent from the foregoing description, the apparatus according to the invention includes a moving structure carrying a printing sheet thereon and adapted to travel between the developing and fixing tanks. As noted above, the advantage of the invention is that both developing and fixing operations can be performed with great ease in a covered processing casing and under bright roomlight without exposing the sheet to the light.

Although the invention has been described by example of the several embodiments, it should be understood that various changes and modifications may be made without departing from the spirit and scope of the invention.

I claim:

1. A photographic processing apparatus comprising:

a casing, developing means and fixing means in said casing, carrier means in the form of a movable plate having a latticed framework for carrying a sheet of printing paper from said developing means to said fixing means, means for moving said carrier means between said developing means and fixing means, said plate having raised portions thereon for pushing a sheet on said plate forward when said carrier means is moved from said developing means to said fixing means, guiding means for guiding said carrier means between said developing means and said fixing means, and stopper means for catching the sheet of printing paper on said carrier means and causing the same to drop into said fixing means when said carrier means is returned from said fixing means back to said developing means.

2. An apparatus as defined as in claim 1 wherein said casing has a removable cover provided on the top thereof, said cover shielding said casing from light to which said printing paper is sensitive.

3. An apparatus as defined in claim 2 wherein said casing and said cover are made of safelight filtering material.

4. An apparatus as defined in claim 1 wherein said developing means and said fixing means are a developing tank and a fixing tank, both open at the top.

5. An apparatus as defined in claim 1 wherein said developing means and said fixing means comprises two rooms formed in said casing and separated by a partitioning member.

6. A photographic processing apparatus comprising:

a casing, developing means and fixing means in said casing, carrier means for carrying a sheet of printing paper from said developing means to said fixing means, guiding means for guiding said carrier means between said developing means and said fixing means comprising two parallel guiding ways formed by said developing and fixing means and provided with a first slope extending toward an inlet of said casing and to said developing means and a second slope of larger inclination and a rectangular opening made through said casing and extending longitudinally of said casing, whereby said guiding means guides said carrier means from near the bottom of said developing means to above said fixing means, and stopper means for catching the sheet of printing paper on said carrier means and causing the same to drop into said fixing means when said carrier means is returned from said fixing means back to said developing means.

7. A photographic processing apparatus comprising:

a casing, developing means and fixing means in said casing, carrier means for carrying a sheet of printing paper from said developing means to said fixing means, guiding means for guiding said carrier means between said developing means and said fixing means, and stopper means for catching the sheet of printing paper on said carrier means and causing the same to drop into said fixing means when said carrier means is returned from said fixing means back to said developing means, said stopper means comprising a pair of bearings, a shaft rotatably supported by said bearings, and a plurality of tines extending downwardly from said shaft.

* * * * *